US009923276B2

(12) United States Patent
Mayer et al.

(10) Patent No.: US 9,923,276 B2
(45) Date of Patent: Mar. 20, 2018

(54) DIPOLE TYPE RADIATOR ARRANGEMENT

(71) Applicant: KATHREIN-WERKE KG, Rosenheim (DE)

(72) Inventors: Josef Mayer, Bernau (DE); Jürgen Hefele, Waakirchen (DE); Carsten Schultheiss, Kiefersfelden (DE); Jörg Langenberg, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 15/179,377

(22) Filed: Jun. 10, 2016

(65) Prior Publication Data

US 2016/0365641 A1 Dec. 15, 2016

(30) Foreign Application Priority Data

Jun. 11, 2015 (DE) ..... 10 2015 007 504

(51) Int. Cl.
*H01Q 9/28* (2006.01)
*H01Q 1/24* (2006.01)
(Continued)

(52) U.S. Cl.
CPC ..... *H01Q 9/285* (2013.01); *H01Q 1/246* (2013.01); *H01Q 1/48* (2013.01); *H01Q 1/50* (2013.01); *H01Q 9/28* (2013.01); *H01Q 21/24* (2013.01)

(58) Field of Classification Search
CPC H01Q 1/48; H01Q 1/50; H01Q 9/285; H01Q 1/246; H01Q 21/24; H01Q 9/28; H01Q 1/24; H01Q 1/38
See application file for complete search history.

(56) References Cited

U.S. PATENT DOCUMENTS 4,800,393 A 1/1989 Edward et al.
6,069,590 A * 5/2000 Thompson, Jr. ..... H01Q 1/42 343/795
(Continued)

FOREIGN PATENT DOCUMENTS

CN 204271259 U 4/2015
DE 196 27 015 1/1998
(Continued)

OTHER PUBLICATIONS

European Search Report dated Nov. 4, 2016, issued in European Patent Application No. 16172969.4.

*Primary Examiner* — Tho G Phan
(74) *Attorney, Agent, or Firm* — Nixon & Vanderhye P.C.

(57) ABSTRACT

An improved dipole-type radiator arrangement is characterized, inter alia, by the following features:

Figure 1:
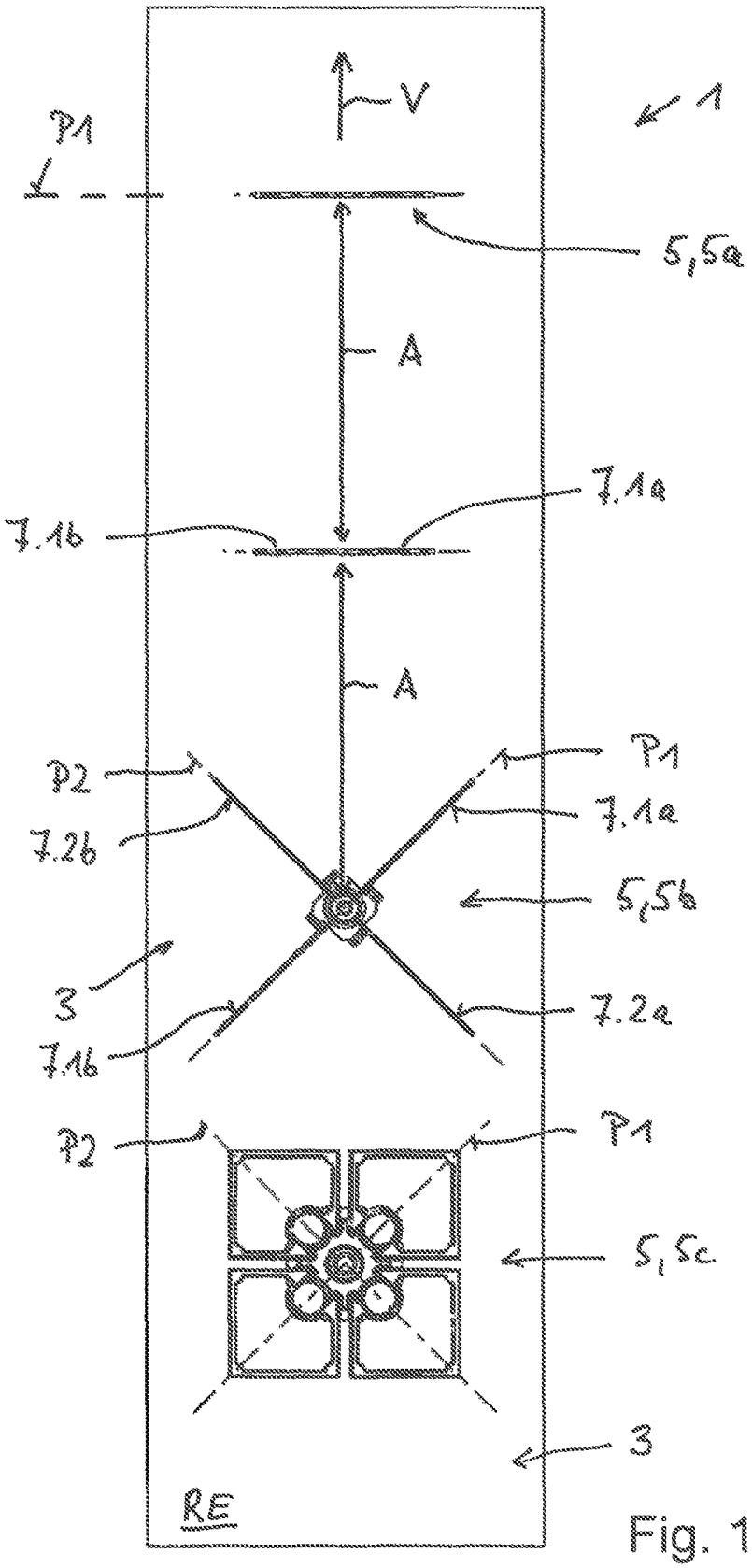

a second two-line system (21.1*b;* 21.2*b*) is provided for the at least one polarization plane (P1, P2), the second two-line feed system (21.1*b;* 21.2*b*) likewise comprises a feed by means of a signal line (27.1*b;* 27.2*b*) and by means of a ground line (25.1*b;* 25.2*b*), the second two-line feed system (21.1*b;* 21.2*b*) is provided opposite the first two-line feed system (21.1*a;* 21.2*a*) with regard to the two radiator halves (7.1*a,* 7.1*b;* 7.2*a,* 7.2*b*) such that the associated second signal line (27.1*b;* 27.2*b*) is galvanically or capacitively coupled to the first radiator half (11.1*a;* 11.2*a*), and the associated ground line (25.1*b,* 25.2*b*) is galvanically or capacitively coupled to the associated second radiator half or mount half (7.1*b,* 11.1*b;* 7.2*b,* 11.2*b*).

15 Claims, 13 Drawing Sheets

(51) Int. Cl.

| | |
|---|---|
| ***H01Q 21/24*** | (2006.01) |
| ***H01Q 1/48*** | (2006.01) |
| ***H01Q 1/50*** | (2006.01) |

(56) References Cited

U.S. PATENT DOCUMENTS

| | | | |
|---|---|---|---|
| 2003/0193377 | A1 | 10/2003 | Quan et al. |
| 2013/0307743 | A1 | 11/2013 | Moon et al. |

FOREIGN PATENT DOCUMENTS

| | | | |
|---|---|---|---|
| DE | 197 22 742 | | 12/1998 |
| DE | 199 01 179 | A1 | 7/1999 |
| EP | 2 406 851 | | 7/2013 |
| WO | WO 00/39894 | | 7/2000 |
| WO | WO 2004/100315 | | 11/2004 |
| WO | WO 2005/060049 | | 6/2005 |

* cited by examiner

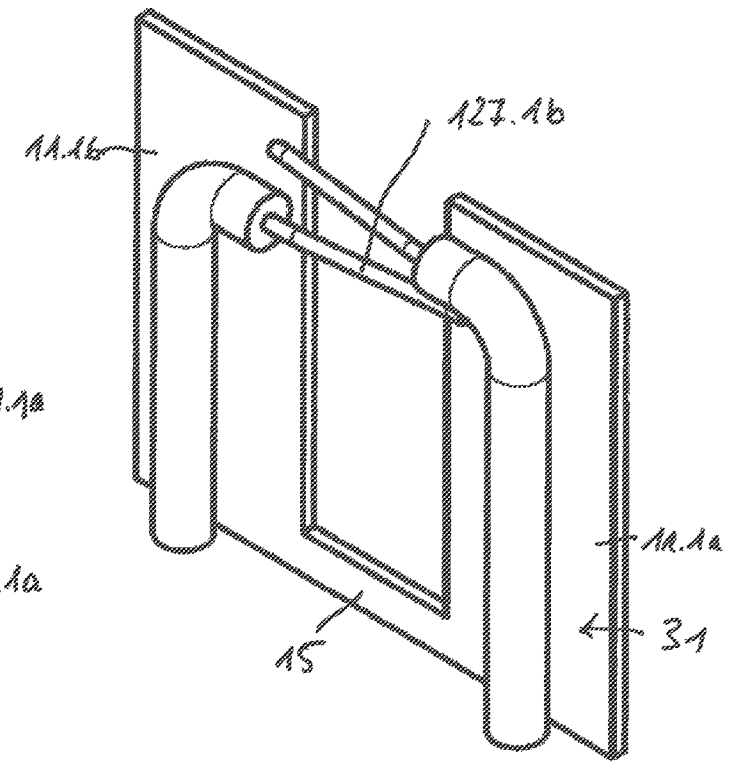
Fig. 3b
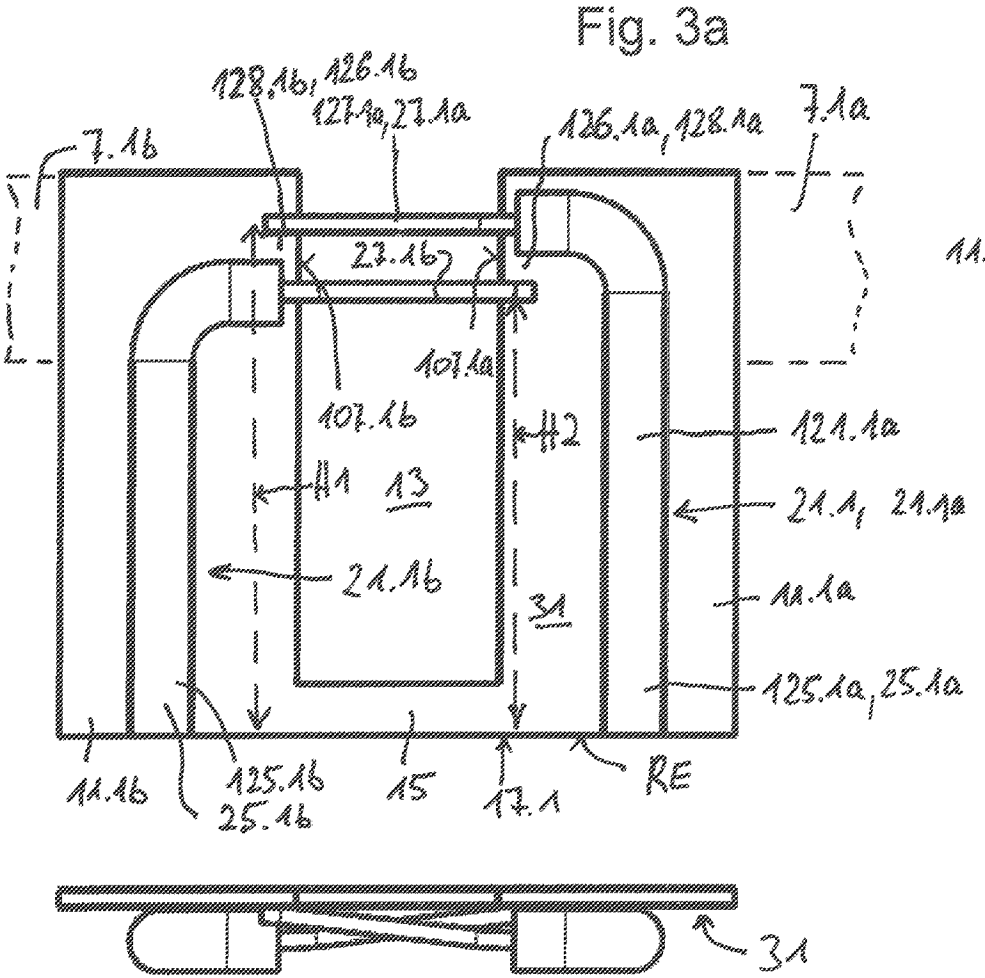
Fig. 3a
Fig. 3c

DIPOLE TYPE RADIATOR ARRANGEMENT

This application claims priority to DE Patent Application No. 10 2015 007 504.7 filed 11 Jun. 2015, the entire content of which is hereby incorporated by reference.

The invention relates to a dipole-type radiator arrangement according to the preamble of claim 1.

Prior publications DE 197 22 742 A and DE 196 27 015 A, for example, disclose dipole radiators. Such dipole radiators can have a standard dipole structure in the form of a single dipole or, for instance, consist of a crossed dipole or a dipole square etc.

Prior publication WO 00/39894, for example, discloses what is called a vector dipole. Structurally, this dipole appears similar to a dipole square. Owing to the specific design of the dipole radiator in this prior publication and to the special feed, however, the action of this dipole radiator is similar to a crossed dipole, which radiates in two mutually orthogonal polarisation planes. In terms of construction, the shape of its outer contour in particular means it is approximately square in form.

WO 2004/100315 A1 discloses another embodiment of the above mentioned vector dipole, in which the planar areas of each radiator half of one polarisation can be enclosed around most of the surface area.

Such dipole radiators are usually fed such that one dipole half or radiator half is DC-coupled (i.e. galvanically coupled) to an outer conductor, whereas the second dipole half or radiator half is DC-coupled (i.e. again galvanically coupled) to the inner conductor of a coaxial connecting cable. The radiators are fed at the facing end regions of each dipole half or radiator half.

In this context, WO 2005/060049 discloses using a capacitive outer-conductor coupling to implement an outer-conductor feed. The support means or each associated half of the support means of the radiator arrangement can hence also be capacitively coupled to ground at its foot region or base or galvanically coupled to the reflector and thereby connected to ground.

Such single-polarised or dual-polarised radiators can also have a very wideband design if applicable, so that they can transmit and/or receive in different frequency ranges or frequency bands.

In addition, such radiators can usually be spaced one above the other in one or more antenna columns. Such antenna arrays can also be driven with a different phase, for example using phase shifters, in particular differential phase shifters, in such a way that a different down-tilt angle can be set. EP 2 406 851 B1, for example, describes a possible arrangement using multipath phase shifters for setting a different down-tilt angle using a suitable feed for dual-polarised radiators. If differential phase shifters are used here, in each case the one end of a phase-changing stripline is connected by a feed line (coaxial feed line) for one polarisation plane to an associated dual-polarised radiator, and specifically, for example, to a radiator which, for a preferably vertically oriented antenna column, lies below the centre, whereas the other end of the same stripline is then coupled via a suitable feed line to a corresponding radiator for the same polarisation plane, which is arranged in an upper half of the antenna array, as disclosed in the above mentioned EP 2 406 851 B1, for example.

US 2013/0307743 A1 is one of several documents also to disclose various embodiments of dipole-type antennas and of crossed radiator arrays that use an unbalanced two-line system, for example, to feed each antenna array radiating in one polarisation plane.

The single-polarised or dual-polarised radiators described normally have an unbalanced feed using a coaxial cable, i.e. a cable having a cable structure that comprises a signal line and a ground line.

A single-polarised dipole radiator is here usually fed by a coaxial line, where the outer conductor of the coaxial cable is soldered to the inside end of one of the radiator halves approximately at the height of the radiator halves, i.e. in particular of the dipole halves. The inner conductor is taken further on to the adjacent inside end of the second radiator half, i.e. specifically of the second dipole half, where the inner conductor forming the signal line is soldered on.

A crossed dipole or a vector dipole having a cross-shaped structure (i.e. having two mutually orthogonal polarisation planes) likewise is provided with a suitable feed for each of the two polarisation planes via a coaxial conductor, as described above.

The object of the present invention is now to create a feed structure that is improved over the prior art.

The object is achieved according to the invention by the features stated in claim 1. The dependent claims define advantageous embodiments of the invention.

A significantly improved feed structure is created surprisingly according to the present invention, which feed structure is advantageous not only in its own right but also offers a range of advantageous possible applications.

Specifically, according to the invention, when an unbalanced feed structure is used, for example using a coaxial cable, a dual feed is provided for the at least one polarisation plane. In the case of a dual-polarised radiator, a dual feed can be implemented for each of the preferably two polarisation planes.

In other words according to the invention, not only is a ground conductor coupled to the one radiator half, and the associated signal conductor coupled to the opposite radiator half, galvanically or if applicable even capacitively, but a second feed structure is also provided.

This second radiator structure in principle has the same or similar design, although the ground conductor of the second feed structure is coupled galvanically or capacitively preferably to the inner end of that radiator half to which the signal conductor or inner conductor of the first feed structure is coupled. Conversely, the signal conductor or inner conductor of the second feed structure is taken beyond the ground conductor to the second radiator half belonging to the same polarisation plane, and coupled here galvanically or capacitively, i.e. to the radiator half to which the ground conductor of the first feed structure is coupled.

If in this case the support means of the dipole-type radiator is inherently provided with a shielded channel, inside of which an inner conductor or signal conductor can be carried in a shielded manner, then the ground connection to the radiator apparatus can be made, for example, also in a region below the actual radiator halves or dipole halves, for instance at the height of the base of the support means of the radiator structure.

Thus in other words there is a dual feed for one or preferably each of the two usually mutually orthogonal polarisation planes.

This dual feed allows, for example, the same physical radiator to be fed for two different frequency ranges via different upstream phase shifters. It is thereby extremely easy to be able to operate the same physical radiators in two different frequency bands, for instance, and to use upstream phase shifters to be able to set a different down-tilt range for these frequency bands or to vary this down-tilt angle.

This improvement can be achieved here without any further increase in the installation space required on the back of the reflector of such a radiator arrangement or of such a radiator array. With today's generation of antennas intended particularly for mobile communications, the back of the reflector normally provided is populated with a multiplicity of components, which means there is almost no free installation space still available here.

The feed structure proposed by the invention merely requires in this situation that the relevant unbalanced lines are taken through from the back of the reflector via suitable apertures or holes to the radiator side of the reflector, i.e. to the front, and specifically up to the relevant coupling points to which the signal lines and the ground lines are coupled to the respective radiator halves.

Furthermore, the invention also allows said unbalanced radiator structure to be implemented easily not just using coaxial cables but also using another two-line feed system, for instance in the form of a microstrip line, a coplanar line arrangement, an arrangement employing single-layer or multi-layer printed boards which are part of the dipole structure and are provided with said microstrip line on the preferably opposite side from the electrically conductive surface of the support means of the radiator structure and/or of the radiator structure or dipole structure itself, one microstrip line being embodied as a ground line and one embodied as a signal line.

Figure 2:
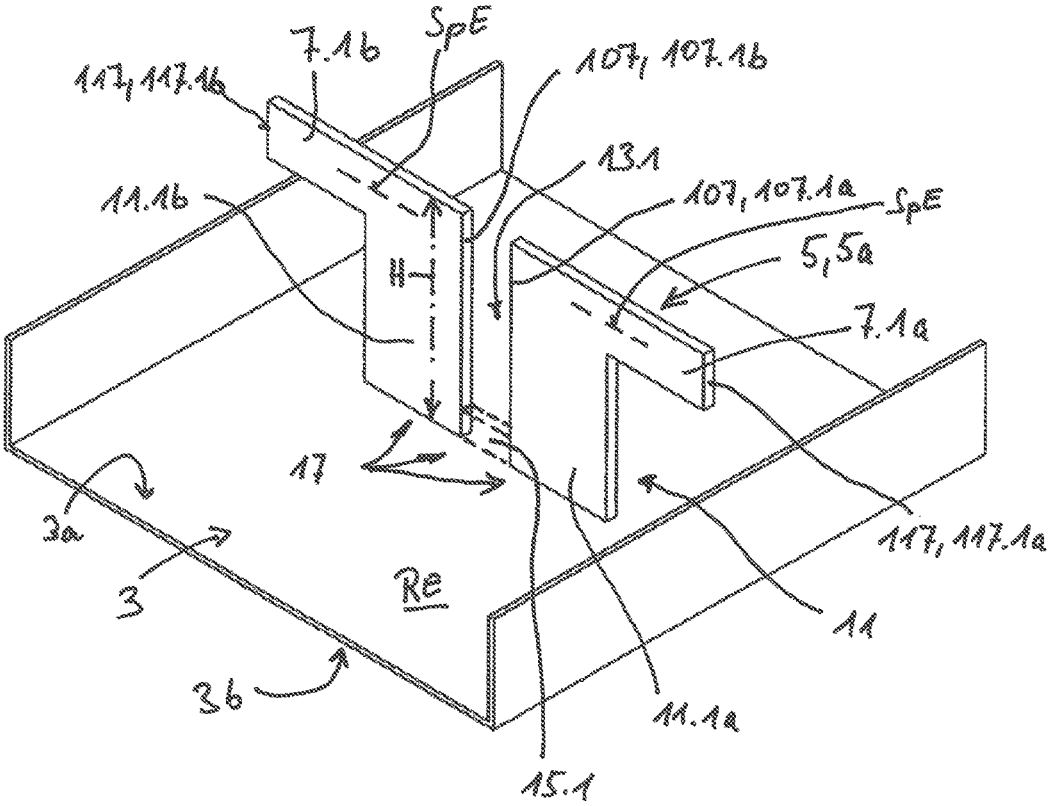
Figure 4B:
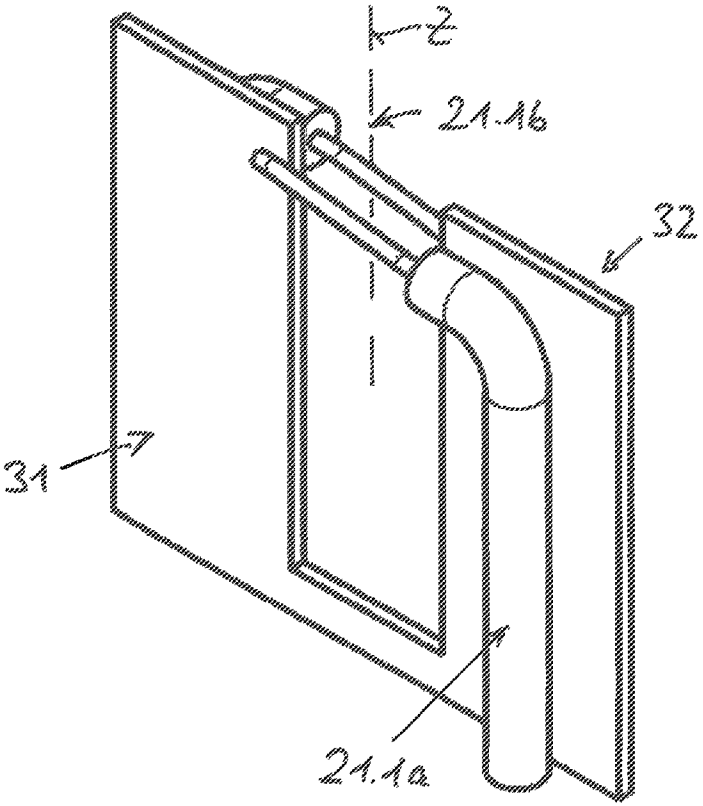
Figure 4A:
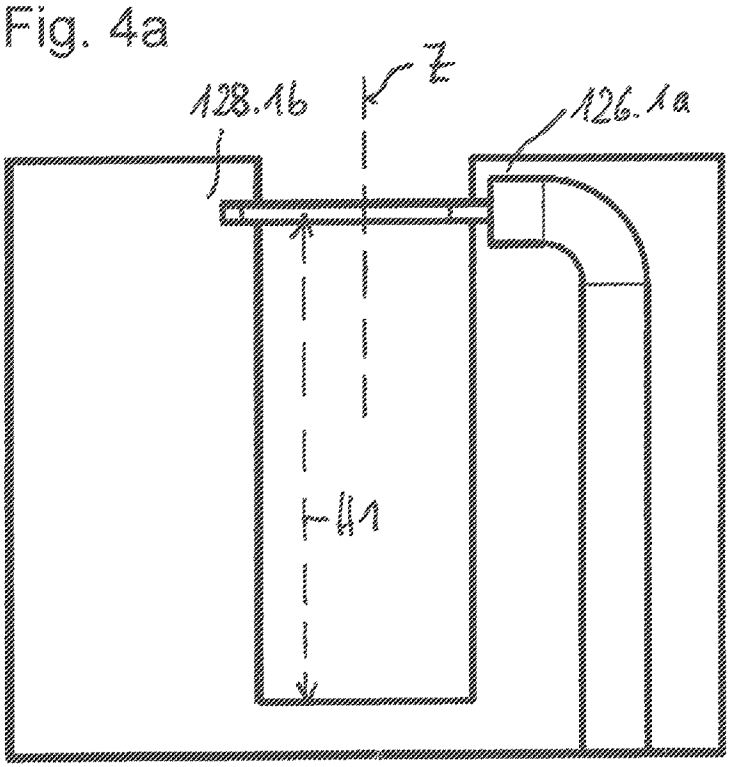
Figure 4C:
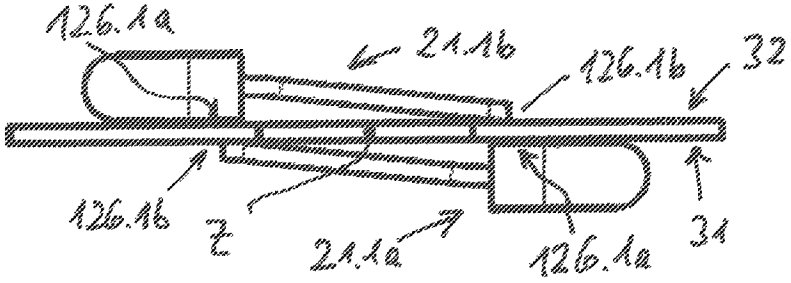
Figure 7A:
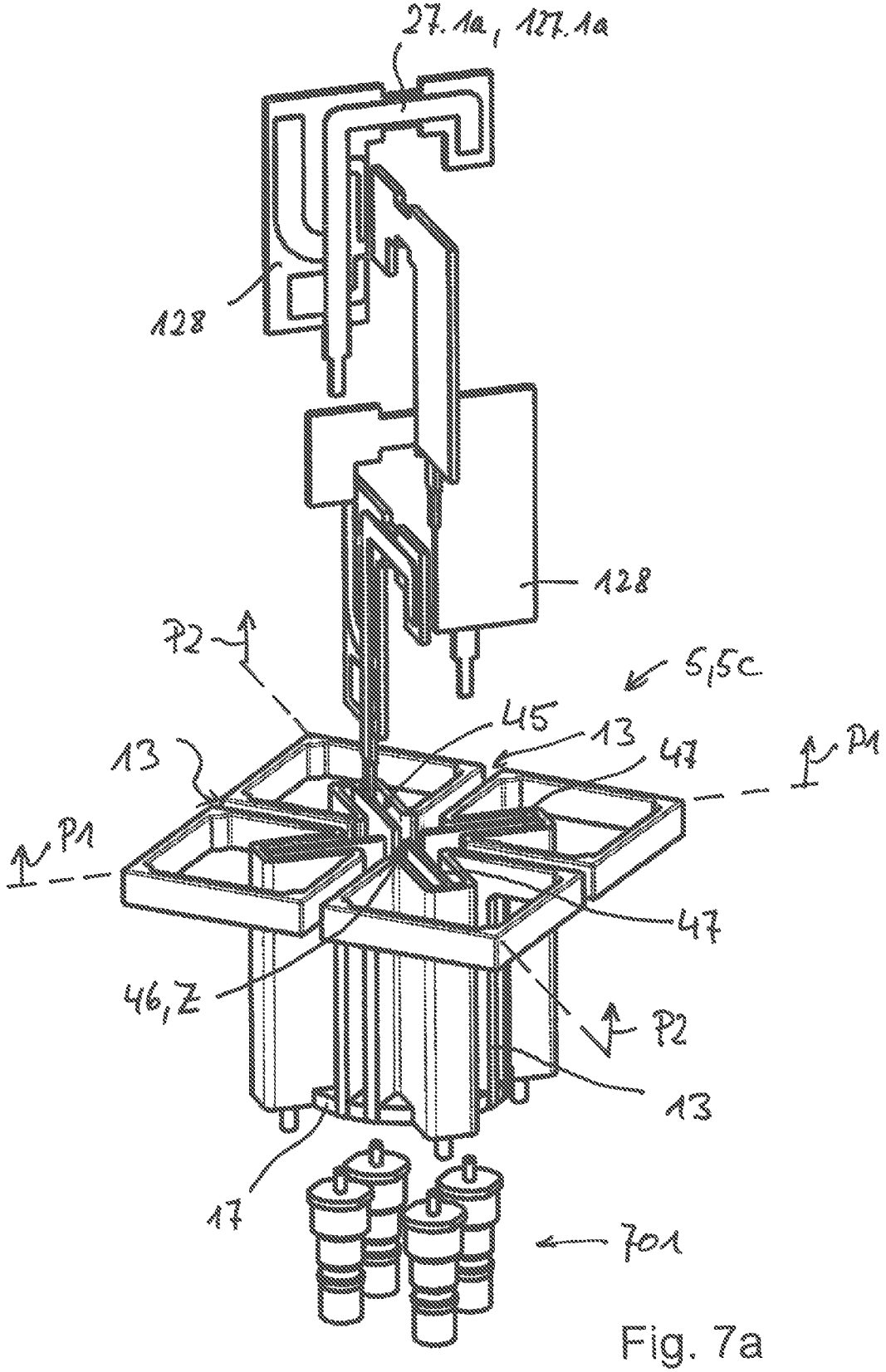
Figure 7B:
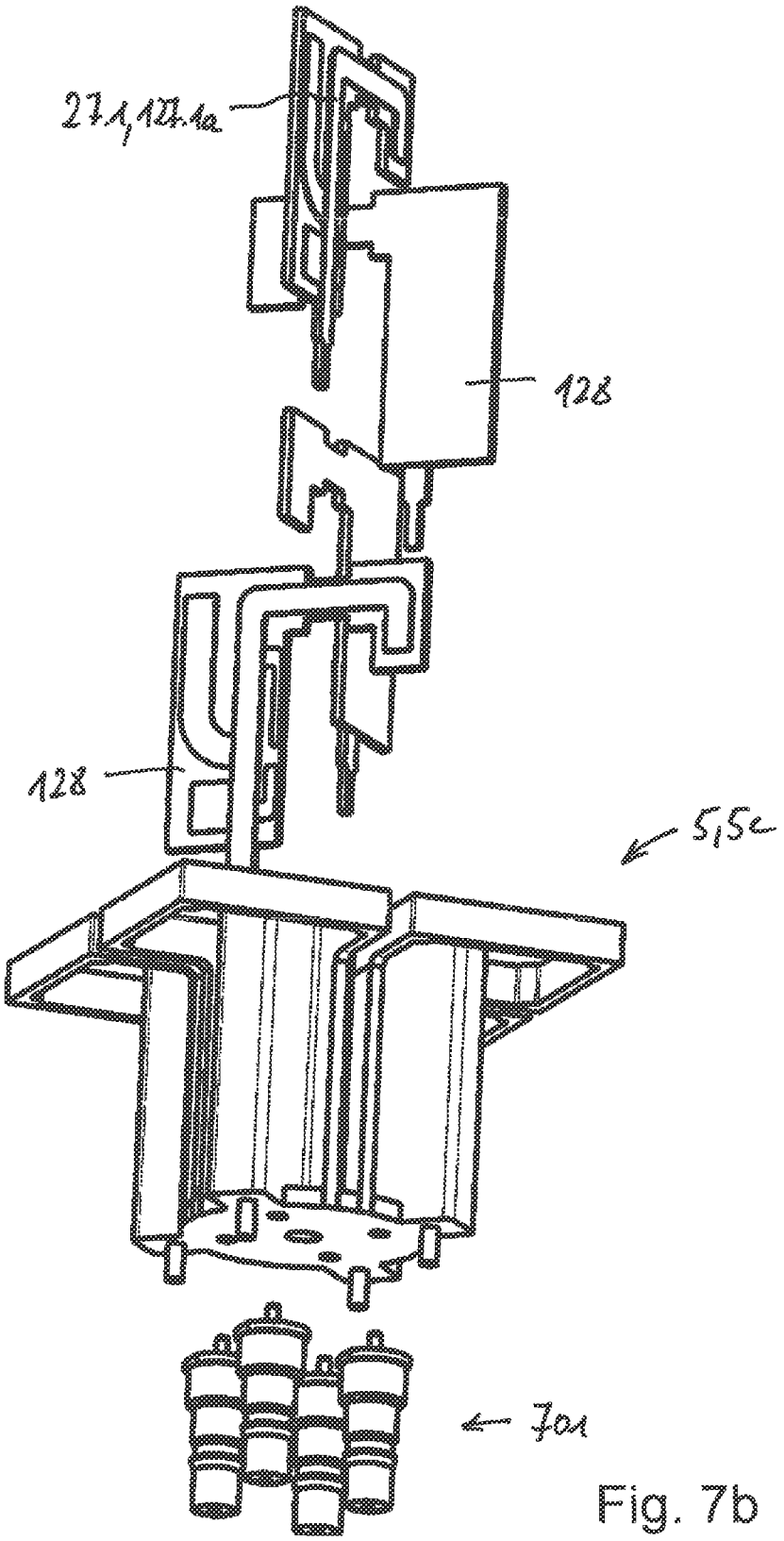
Figure 7C:
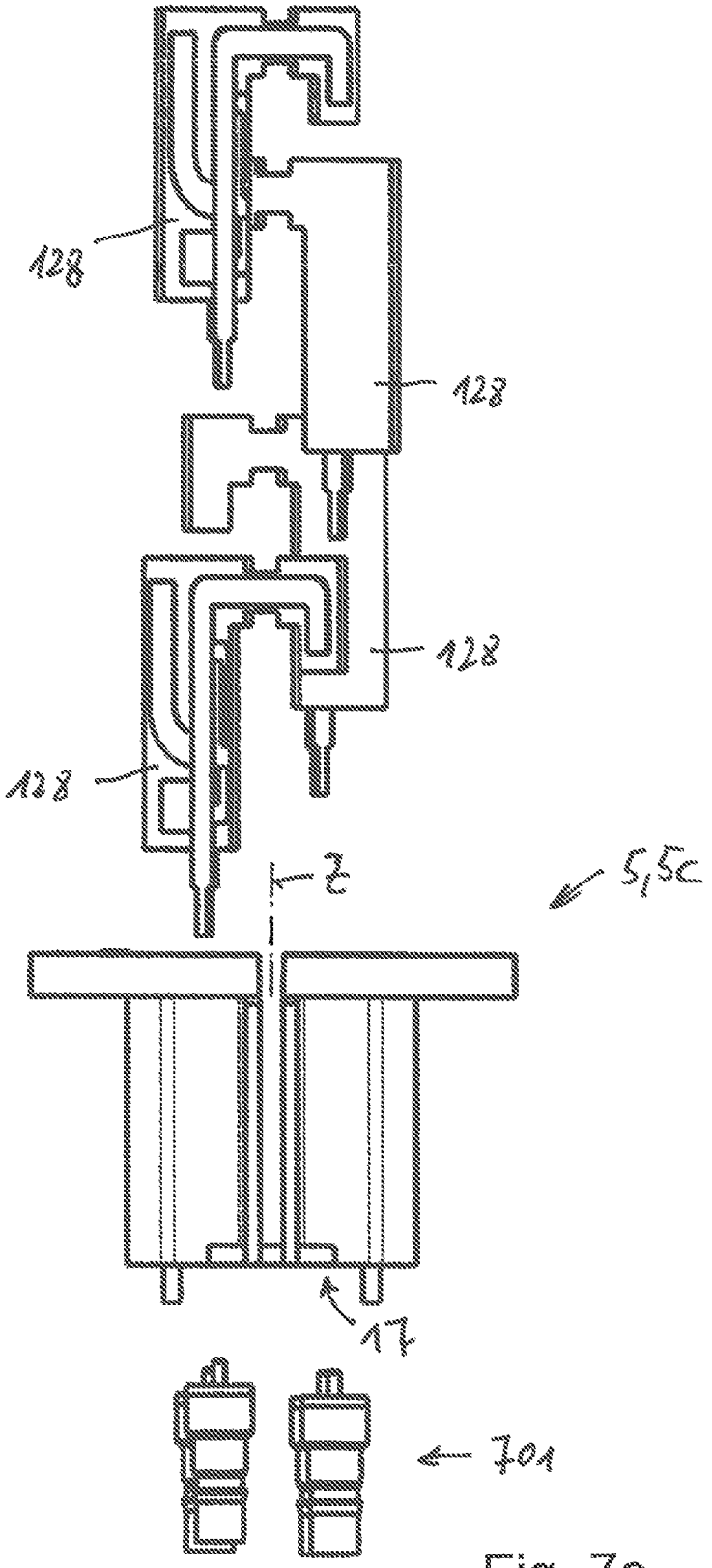
Figure 8:
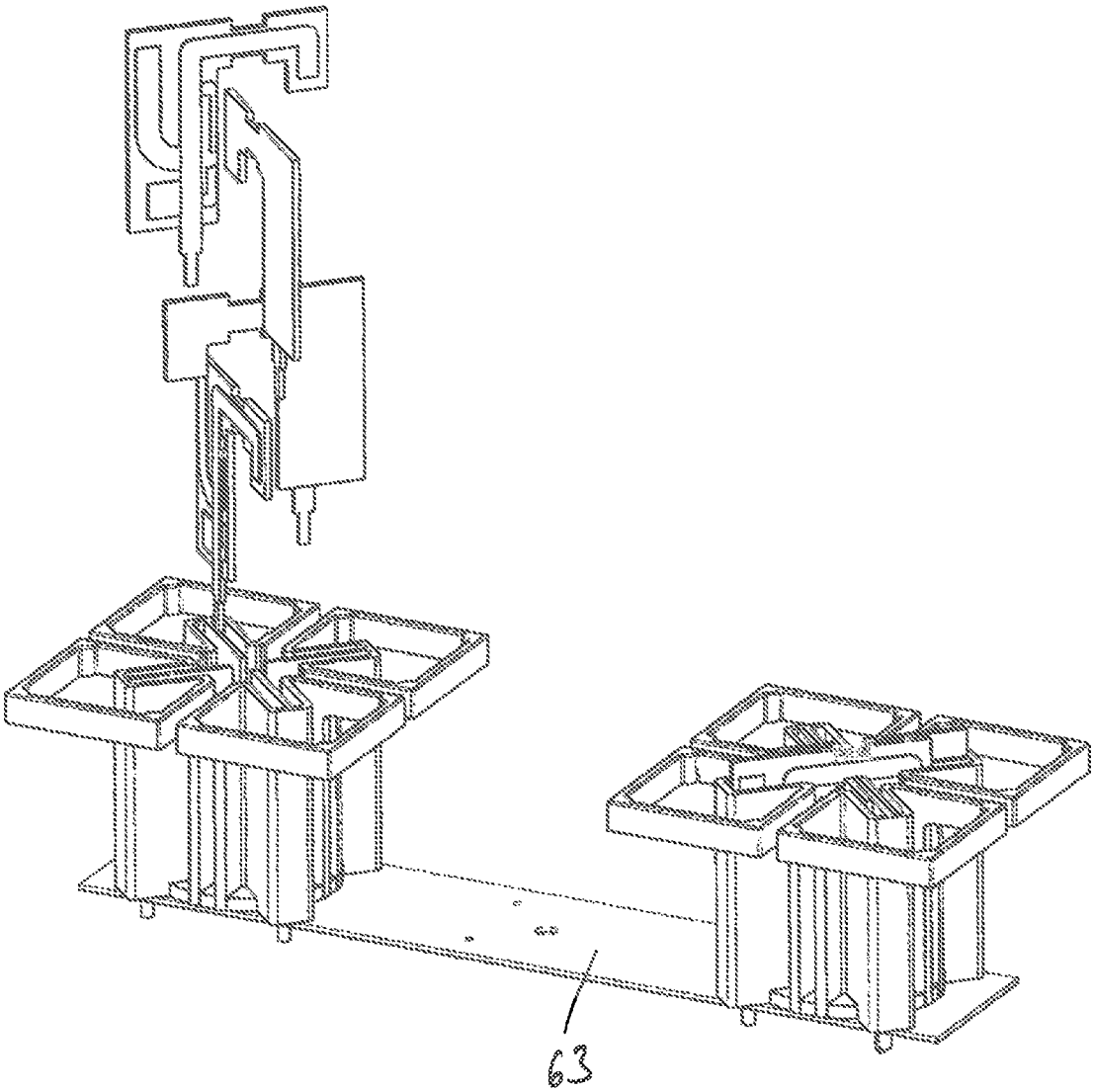

The invention is explained in more detail below with reference to drawings, in which:

FIG. 1: is a schematic plan view of a single-column antenna array showing different dipole radiators that can be used according to the invention;

FIG. 2: is a three-dimensional diagram, parts of which have been simplified, of a single-polarised dipole radiator, as can be used according to the invention;

FIGS. 3*a* to 3*c*:

are simplified diagrams in side view, three-dimensional view and plan view respectively showing a first embodiment according to the invention;

FIGS. 4*a* to 4*c*:

are three further diagrams of the embodiment of FIGS. 3*a* to 3*c* showing a slightly modified embodiment according to the invention;

FIGS. 5*a* to 5*e*:

are two three-dimensional views, a side view, a plan view and another three-dimensional view of a crossed dipole radiator according to the invention having two feed systems provided according to the invention for each polarisation plane;

FIGS. 6*a* to 6*d*:

are different views of an embodiment that is similar to the previous embodiment and having larger mounting plates for the two feed systems of each polarisation plane in order to accommodate additional functional parts;

FIGS. 7*a* to 7*c*:

are two three-dimensional views and a side view of a modified embodiment using a vector dipole and having two feed systems for each polarisation plane; and FIG. 8: is a three-dimensional view of a dual arrangement according to the invention of two vector dipoles of a common mounting plate.

FIG. 1 shows in a schematic plan view an antenna arrangement, i.e. specifically a single-column antenna array 1, which is usually mounted such that it extends in a vertical direction.

This antenna array 1 comprises a reflector 3, which is shown viewed onto the vertical plane in FIG. 1.

In the vertical or longitudinal direction V of the antenna array 1, radiators 5 are mounted usually at equidistant intervals A (distance A between two centres of two radiators, which centres are adjacent in the V-direction).

In the view of FIG. 1, two single-polarised radiators 5*a* spaced apart from one another in the direction V are shown by way of example, the two dipole radiator halves 7.1*a* and 7.1*b* of which are oriented transverse to, and in particular perpendicular to, the vertical or longitudinal direction V. This arrangement defines an associated polarisation plane P1 lying perpendicular to the reflector plane RE, which polarisation plane is shown dashed in FIG. 1 and lies perpendicular to the reflector plane RE and hence perpendicular to the drawing plane.

In addition, purely for illustrative purposes, the figure shows in plan view a dipole-type crossed radiator 5*b* offset from the two above mentioned single-polarised radiators 5*a*, and what is called a vector radiator 5*c* again lying at an offset, which radiators have two mutually orthogonal polarisation planes P1 and P2. To improve clarity, an equally suitable dipole square has not been shown, even though it could be used in exactly the same way.

Whereas the radiators 5*a* are single-polarised dipole radiators, the dipole cross 5*b* and the vector dipole 5*c* shown in FIG. 1 would be able to transmit and/or receive in two mutually orthogonal polarisation planes P1 and P2, just as would be the case in a correspondingly oriented dipole square, for example.

The actual radiator elements i.e. the dipole halves 7.1*a* and 7.1*b* for single-polarised radiators, and the radiator halves 7.1*a*, 7.1*b* and 7.2*a*, 7.2*b* for dual-polarised radiators, typically extend parallel to the reflector plane RE at a separation from the reflector 3.

The various radiators are shown in FIG. 1 merely by way of example in order to illustrate that an antenna array 1 can be designed using different radiators 5*a*, 5*b* and/or 5*c*, i.e. using radiators of the same type or also radiators of different design. Hence the structures may also be different, in which case it is also possible to use differently designed radiators that radiate in different bands. In particular when using vector radiators 5*c*, these radiators can have an inherently wideband design so that they can transmit and/or receive in at least two or even in a plurality of frequency bands offset from one another.

FIG. 2 shows a corresponding three-dimensional view of the antenna array shown in FIG. 1, although showing only a simplified view of a single dipole radiator 5*a* that radiates only in one polarisation plane P1.

Such dipole-type radiators usually comprise a mount 11, which in the case of a dipole radiator 2 comprises mount halves 11.1*a* and 11.1*b*, which extend from the reflector plane RE of the reflector 3 up to the height of the dipole halves 7.1*a* and 7.1*b* running laterally away from one another, and specifically forming a slot 13.1 provided therebetween, which in the case of a dipole can also be referred to as a balancing slot 13.1.

The dipole halves 7.1*a* and 7.1*b* are separated from one another by said slot 13.1 at the height of the radiators, and hence have what are termed inner radiator end segments 107, i.e. 107.1*a* and 107.1*b*, lying adjacent to each other, and, lying at a distance therefrom, outward-facing radiator end segments 117.1*a* and 117.1*b*, which are referred to below also as outer radiator end segments 117.1*a*, 117.1*b*.

Such a dipole, or generally dipole-type radiator, can be made from a conductive metal, for instance from a casting. As will be shown later, a suitable dipole, for instance a crossed dipole, may also consist of a sheet metal part or be made from a sheet metal part, which can be suitably formed by bending, punching, trimming and/or folding. Likewise, however, it is also possible to form such dipole-type radiators, for instance, using a dielectric e.g. in the form of a single-layer or multilayer printed circuit board, or using a suitable circuit board material, which is coated with a metallised layer at least on one side i.e. on the front or the back. The entire surface is preferably metallised accordingly.

The slot 13.1 extends practically over the entire height of the dipole, as mentioned, or in a variant of the embodiment shown in FIG. 2, can comprise a connecting link 15.1 that lies at the bottom adjacent to the reflector 3 and connects the two mount halves 11.1*a* and 11.1*b*, thereby forming the overall common base 17 of the mount 11.1 and hence the base 17 of the radiator 5. This connecting link 15.1, as one of the possible variants, is shown merely dashed in FIG. 2, because the radiator halves 7.1*a* and 7.1*b* can be separated by the slot 13 also as far as the reflector plane RE.

As FIG. 2 basically shows, the coupling of the underside of the mount 11.1 or of the two mount halves 11.1*a*, 11.1*b*, with or without an additional connecting link 15.1, (i.e. in general terms the common or separate base 17.1) can be made preferably by galvanic contact to the conductive reflector 3. The embodiment using a capacitive coupling is also possible here, however. If an insulating intermediate layer is provided between the base 17, i.e. the underside of the base 17 (with or without connecting link 15.1 shown in FIG. 2), and the electrically conducting reflector layer, this produces a capacitive coupling of the respective radiators to the reflector 3. In other words, a capacitive coupling, or if required even a galvanic coupling, to the reflector can be provided here at the base 17 of the mount 11.

The embodiments presented above also apply in principle generally to other dual-polarised radiator types, for example to the above mentioned crossed radiators 5*b* and especially also to the vector dipole 5*c*.

The feed height or the feed plane SpE, which is shown dashed in FIG. 2, is usually designed to be in the region of the dipoles 7.1*a* and 7.1*b* and runs parallel to the reflector plane RE. The feed for the transmit signals and/or the receive signals, which is explained in detail below, is typically implemented at this feed height or in this feed plane. It is entirely possible here that the feed can also be provided in a certain region below the height region in which the dipole halves or radiator halves 7.1*a* and 7.1*b* are formed.

The radiator height H with respect to the reflector plane RE and hence effectively the length of the slot 13.1 typically equals a value of approximately $\lambda/4$. The radiator height and/or the slot length should preferably not be less than a value of $\lambda/10$, however. In principle there is no upper limit, and so in principle the radiator height could equal any multiple of $\lambda$ (especially since a radiator has a radiation pattern even without a reflector). A here preferably represents a wavelength from the frequency band to be transmitted, preferably at a centre frequency of the band to be transmitted. If the radiator is a wideband radiator transmitting two or more frequency bands, the value for $\lambda$ should preferably equal a value in the centre of the entire frequency band range from the lowest to the highest value of the various frequency bands.

Details of the dipole feed are described below.

FIG. 3*a* shows in a schematic side view, FIG. 3*b* in a three-dimensional view, and FIG. 3*c* in a plan view a detail of the dipole radiator 7.1 depicted in FIGS. 1 and 2, namely comprising its two mount halves 11.1*a*, 11.1*b* and the bottom connecting link 15, but without the dipole halves or radiator halves 7.1*a*, 7.1*b* extending away from each other at the top end of the mount 11.1, which are merely suggested in FIG. 3*a*.

Such a dipole radiator in this case normally has an unbalanced feed, namely using a two-line feed 21.1, 21.1*a*, e.g. in the form of an unbalanced coaxial cable 121.1*a*, which is taken from the underside or back of the reflector 3 via an aperture or hole in the reflector 3 through to the radiator side and then runs along a mount half, for example the mount half 11.1*a*, towards the top end of the mount 11.1.

The upper end of the ground conductor 25.1, in the form of an outer conductor 125.1*a* in the case of a coaxial cable 125*a*, can be coupled capacitively and preferably galvanically in particular by soldering to the electrically conducting surface of the adjoining mount half 11*a*, i.e. for example to a ground feed point 126.1*a*. Usually the outer conductor of the coaxial cable 125.1 shown in FIGS. 3*a* to 3*c* is also enclosed by an insulating outer sheath, which runs up to the vicinity of the feed point 126.1*a* to which the then exposed outer conductor is soldered at the top end of the mount for the radiator. This insulating outer sheath is not shown in the figures for the sake of simplicity.

In the embodiment of the mount 11.1 described above having the two mount halves 11.1*a* and 11.1*b* and the slot 13 separating said mount halves, a short-circuit that exists between the mount base and the reflector is transformed into an open-circuit at the dipole height (a height with respect to the reflector plane of approximately $\lambda/4$), thereby establishing the desired balun effect. $\lambda$, however, typically and preferably represents the centre wavelength of the frequency band to be transmitted.

The signal line 27.1, here in the form of an inner conductor 127.1*a* of the coaxial cable 121.1*a*, runs inside the coaxial ground line 25.1, i.e. inside the outer conductor 125.1*a*, with the inner conductor being taken further on across the slot 13 and being coupled capacitively or galvanically to the opposite segment of the other dipole half or radiator half 7.1*b*. In the embodiment shown, the connection is intended to be made galvanically by soldering. In other words, the signal is coupled in via the signal line, here in the form of the inner conductor 27.1*a*, at a signal feed point 128.1*b* at the top and inside region of the second mount half 11*b*.

In other words, the feed is made at feed points or feed locations 126.1*a* and 128.1*b* formed at a distance from the reflector 3, in the region or vicinity of the open end of the slot 13 in a region adjacent to the two facing, i.e. inside, radiator end segments, i.e. what are termed the inner radiator end segments 107.1*a* and 107.1*b*, said feed being made by galvanically or capacitively coupling the ground conductor 25.1*a* to the one feed point 126.1*a*, and the signal conductor 27.1*a* to the other feed point 126.1*b*.

The design described so far using just one feed system 21.1*a* would correspond to the prior art.

As is also evident from FIGS. 3*a* to 3*c*, however, according to the invention a second feed 21.1*b* having an exactly opposite design to the first feed is also provided on the same radiator or dipole 5.

According to the embodiment described, the second two-line feed 21.1*b* can be provided, for example, in the form of another coaxial cable 121.1*b*, which runs, for instance, on the second mount half 11.1*b* from the back of the reflector through a hole in the outer or inner reflector towards a top end of the mount 11.1. Again in this case, the associated ground conductor 25.1*b* in the form of the associated outer conductor 125.1*b* is again coupled capacitively or galvanically to the associated mount 11.1*b* in the region of the top feed point 126.1*b* and hence coupled capacitively or galvanically to the associated dipole half or radiator half 7.1*b*. Again in this case, the signal line 27.1*b*, here in the form of the inner conductor 127.1*b*, extends across the slot 13 in the opposite direction to the inner conductor 127.1*a* of the first two-line feed 21.1*a* to the opposite segment of the mount half 11.1*a* and hence to the inside feed point 128.1*a* on the inner radiator end segment 107.1*a* of the associated dipole half or radiator half 7.1*a*, and is coupled there galvanically or capacitively.

Such a design allows the same radiator 5 to be operated in two different frequency ranges, for example, wherein the one frequency band can be implemented in the transmit and/or receive direction via the one two-line feed 21.1*a*, here in the form of the coaxial cable 121.1*a*, and another two-line feed 21.1*b* can be implemented, for example, for a second frequency range via the second coaxial cable 121.1*b*. The special feature now is that different phase adjusters, for example in the form of phase shifters and in particular differential phase shifters, can be connected in series before the two coaxial cables 121.1*a* and 121.1*b* so that the different frequency ranges that the same radiators 5 transmit and receive can be easily set at different down-tilt angles that are separate from one another.

In the variant of FIGS. 3*a* to 3*c*, the coaxial cables 121.1*a*, 121.1*b* are arranged with their ground conductors or outer conductors and their inner conductors or signal conductors on the same side of the associated dipole or radiator 5, for example on the first side or front 31, which is visible in FIGS. 3*a* and 3*b*. Therefore the two outer conductors 125.1*a* and 125.1*b* terminate at a slightly different height H1 and H2 respectively with respect to the reflector plane RE i.e. to the underside of the base 17.1, in order that the lines can be mounted without making contact.

In the embodiment shown in FIGS. 4*a* to 4*c*, the one coaxial two-line feed system 21.1*a* is formed for example on the first side or front 31 of the radiator or dipole rising preferably perpendicular to the reflector plane RE, whereas the second two-line feed mechanism 21.1*b* is formed on the opposite, second side or back 32 of the dipole or radiator 5, i.e. in plan view, is formed on an orientation and arrangement that is rotated through 180° about a centre axis passing through the centre of the radiator and standing perpendicular to the reflector plane RE. Hence in this case the feed points 126.1*a* and 126.1*b* for the ground conductors or outer conductors of the two coaxial cables 121.1*a* and 121.1*b*, and the feed points 128.1*b* and 128.1*a* for the inner conductors or signal conductors 27.1*a*, 27.1*b* typically lie at the same height level H1, although again also in this case a certain height difference would certainly be possible.

Another embodiment is also described below with reference to FIGS. 5*a* to 5*e*.

Unlike the embodiment shown in the figures described first, this embodiment involves a crossed dipole radiator 5*b*, which transmits and receives in two mutually orthogonal polarisation planes P1 and P2.

The further difference from the previous embodiment is that the unbalanced two-line system 21.1 and 21.1*b* is implemented not by means of coaxial cable 121 but using microstrip lines 221 (striplines).

It must be pointed out here that also for the embodiment having a dual-polarised radiator as shown in FIGS. 5*a* to 5*e*, a feed could be implemented using a two-line system 21.1 and 21.2 respectively for each of the two polarisation planes P1, P2, and specifically using coaxial cables 121 as was described with reference to the previous embodiment. Equally, the two-line feed system 21.1 and 21.2 described below could be implemented for one or both polarisation planes P1, P2 and also in the previously described embodiment not by means of coaxial cables 212 but using microstrip lines 221, and indeed different feed-line systems, in particular unbalanced feed-line systems, are fundamentally possible.

It can be seen from FIGS. 5*a* to 5*e* that the crossed radiator 5*b* comprises two mutually orthogonal dipoles 7.1 and 7.2, each having two dipole halves or radiator halves 7.1*a*, 7.1*b* and 7.2*a*, 7.2*b* lying in the associated polarisation planes P1, P2, wherein the polarisation planes P1, P2, as also in the first embodiment, in accordance with the design of the radiator are oriented perpendicular to the reflector plane RE. The two polarisation planes P1 and P2 intersect in the centre of the radiators such that the two dipole halves 7.1*a*, 7.1*b* lie in the first polarisation plane P1, and the two radiator halves or dipole halves 7.2*a*, 7.2*b* orthogonal thereto lie in the second polarisation plane P2.

Each of the mounts 11.1 and 11.2 lying parallel to the polarisation planes P1, P2 and comprising the associated mount halves 11.1*a*, 11.1*b* and 11.2*a*, 11.2*b* respectively can consist of metal or metal plates, in particular of one or more joined sheet-metal parts. It is equally possible that these mounts are formed, for example, from printed circuit board material, i.e. from a dielectric, where at least one and preferably both of the opposite faces are coated in an electrically conducting layer, which layers are coupled to one another preferably galvanically.

The respective pairs of mount halves 11.1*a*, 11.1*b* and 11.2*a*, 11.2*b*, which with regard to the two polarisation planes P1, P2 are mutually orthogonal, can be mounted and/or held on a common base 17, to which they are likewise preferably coupled galvanically. The base and also the radiator as a whole can be coupled galvanically or even capacitively as described to an electrically conducting reflector via a hole 18 provided for instance centrally in the base 17, by means of which it is accordingly coupled electrically and retained mechanically.

The two feed systems basically have a design that is similar and comparable to the previous embodiment.

For the variant shown in FIGS. 5*a* to 5*e*, the connection of a ground line 25 (as has already been described in general terms with reference to FIGS. 3*a* and 3*b*), i.e. in the present case the connection of a ground line 25.1*a*, 25.1*b* and 25.2*a*, 25.2*b*, can be made for example via the galvanic coupling of the bottom end of the mount 11, i.e. of the respective mount halves 11.1*a*, 11.1*b* and 11.2*a*, 11.2*b*, not only directly but e.g. also via the electrically conducting base 17 to the reflector 3 and/or via a separate ground connection line (which is not shown in FIGS. 5*a* to 5*e*). Otherwise, a suitable line connection from the back of the reflector 3 through a suitable hole can be used to make a galvanic or capacitive coupling for the ground line e.g. in the vicinity of the top regions of a mount half 11.1*a*, 11.1*b* and 11.2*a*, 11.2*b*, as described with reference to FIGS. 3*a* to 4*c*.

The signal lines 27.1*a*, 27.1*b* and 27.2*a*, 27.2*b* provided in pairs in the embodiment shown in FIGS. 5*a* to 5*e* (of each pair, only the signal lines 27.1*a* and 27.2*a* that are located on the one side of the mount halves are visible owing to the view) are each in this embodiment preferably in the form of a microstrip line (i.e. stripline) 221.*a*, 221*b* and 221.2*a*, 221.2*b*, i.e. a track on a suitable dielectric 128, for example in the form of a printed circuit board material 128, which hence serves as a substrate or mount, in this specific case as a mounting plate.

Each ground line 25.1*a*, 25.1*b* and 25.2*a*, 25.2*b*, in microstrip form 221.1*a*, 221.1*b* and 221.2*a*, 221.2*b* respectively, is here designed to have a shape like an inverted L viewed face on from the side or to be approximately L-shaped, where the associated mount or the substrate 128 may also be, but need not be, designed with a corresponding shape.

This printed circuit board material 128 on which is located the microstrip feed line or signal line 27.1, 27.2, for each polarisation P1 or P2 is provided in a parallel arrangement adjoining, or at a short distance from, the actual planar mount 11, i.e. the relevant mount half 11.1 and 11.2 respectively, for each polarisation in the form of mount halves 11.1*a*, 11.1*b* and 11.2*a*, 11.2*b* respectively. The electrically conducting surface of the mount 11 acts here as the ground plane for the microstrip track lying spaced apart therefrom by the thickness of the substrate 128. In other words, the signal lines 27.1*a*, 27.1*b* and 27.2*a*, 27.2*b* hence each preferably lie facing outwards on the associated non-conducting surface of the mount 11.

Alternatively and additionally, for the purpose of forming the microstrip tracks, an associated ground plane can be formed on the immediate opposite rear side of the substrate 128, which ground plane is preferably isolated from the ground plane of the mount halves by the interposition of a dielectric film or an air gap.

In this case, for the polarisation P1 for example, namely for the first feed system 21.1*a*, the design is such that the corresponding mount structure, which approximates an inverted L and is in the form of the mount 128 on which is located the track 127.1*a*, is positioned in contact with the one side 31 of the associated mount halves. The second feed system 21.1*b* provided for the same polarisation plane is preferably arranged on the opposite side of the same mount half, so that the feed has an inverted design for each polarisation, as was described with reference to FIGS. 4*a* to 4*c* for a coaxial cable feed.

The feed for the second polarisation P2 is made correspondingly in microstrip form, so that there are two feed systems 21.1*a*, 21.1*b* and 21.2*a*, 21.2*b* for the first polarisation plane P1 and two feed systems for the second polarisation plane P2.

In this case, each planar dielectric mount (substrate) 128 preferably comprises a tab 128*a* protruding at the bottom end, where the signal track or track 27.1*a*, 27.1*b*, 27.2*a*, 27.2*b* provided on the planar dielectric mount 128 extends into the region of the protruding tab 128*a*. The corresponding track 27 here preferably terminates in the region of this protruding tab 128*a*, which in the assembled state preferably protrudes via a hole or aperture in the reflector 3 from the radiator side or front through to the back of the reflector, so that there the relevant end 27' of the signal conductor 27.1*a*, 27.1*b* and 27.2*a*, 27.2*b* can be connected to a corresponding feed network (usually by soldering). The signal line in the form of the track thus runs parallel to the track mount segment, which is located therebehind and is in the form of said dielectric 128, from the tab 128*a* up to the height of the top dipole segment or radiator segment 7.1, 7.1*b* and 7.2*a*, 7.2*b*, in order then to change into a line segment running at right angles thereto, which terminates in the region of the opposite dipole half or radiator half in parallel therewith. For each of the two polarisation planes this results in e.g. a capacitive coupling between the segment of the microstrip line 221.1*a*, 221.1*b* and 221.2*a*, 221.2*b* taken across the slot 13. Then the corresponding signal-conductor feed point 126.1*a*, 128.1*b*, 126.1*b*, 128.1*a* for the one polarisation plane P1, and the signal-conductor feed point 126.2*a*, 128.2*b* and 126.2*b*, 128.2*a* for the other polarisation plane P2 effectively exist in these regions.

Figure 5A:
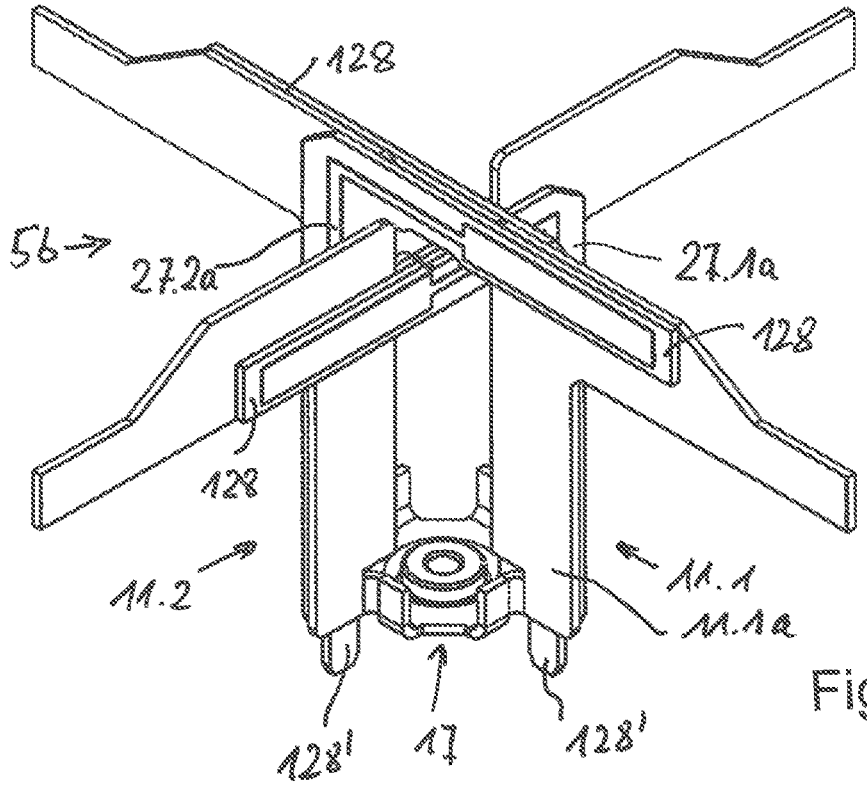
Figure 5B:
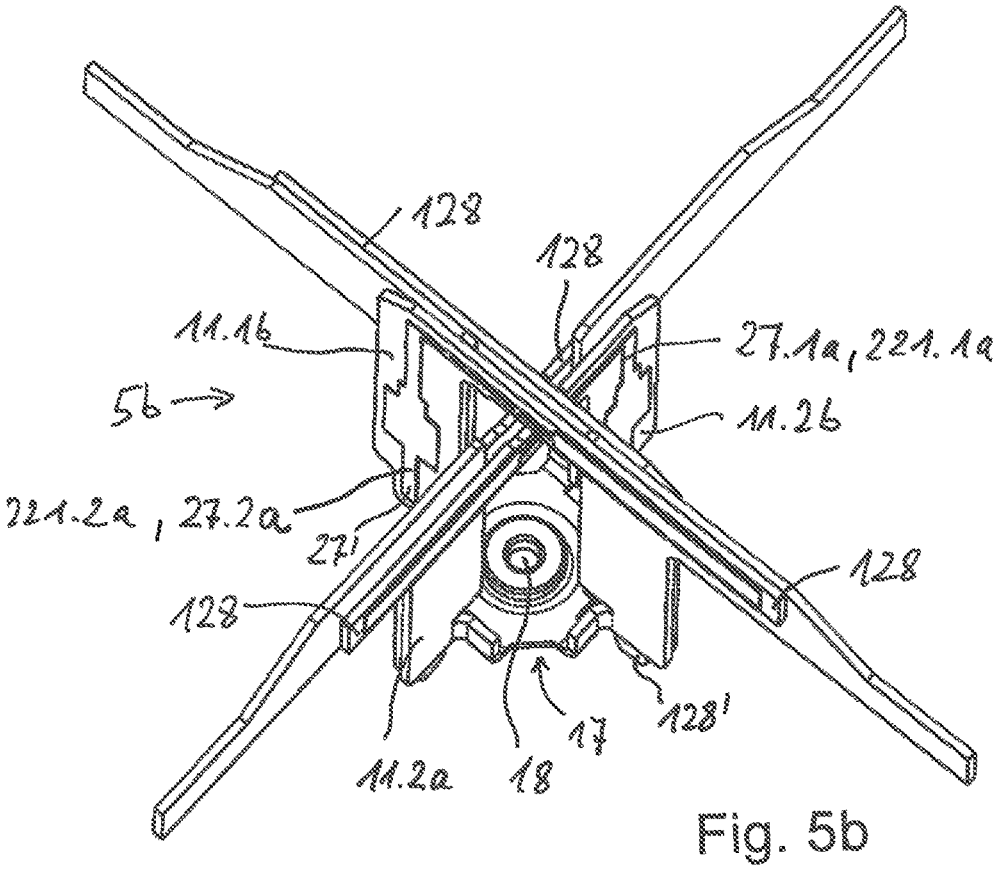
Figure 5C:
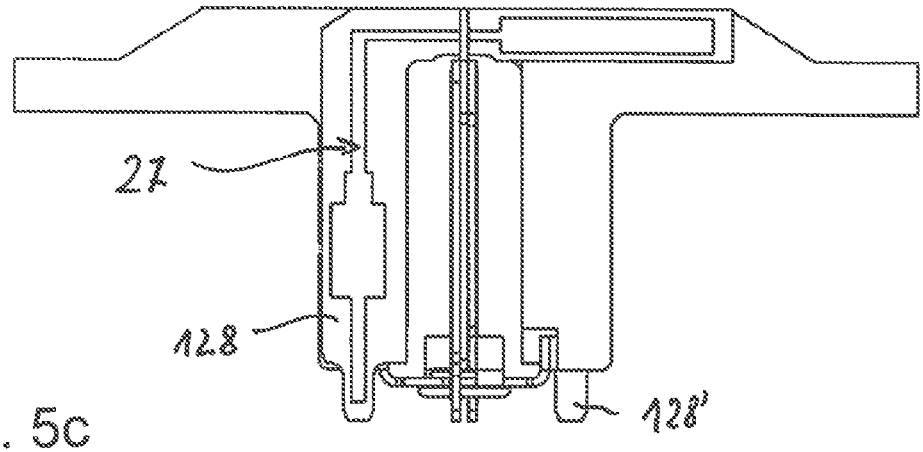
Figure 5D:
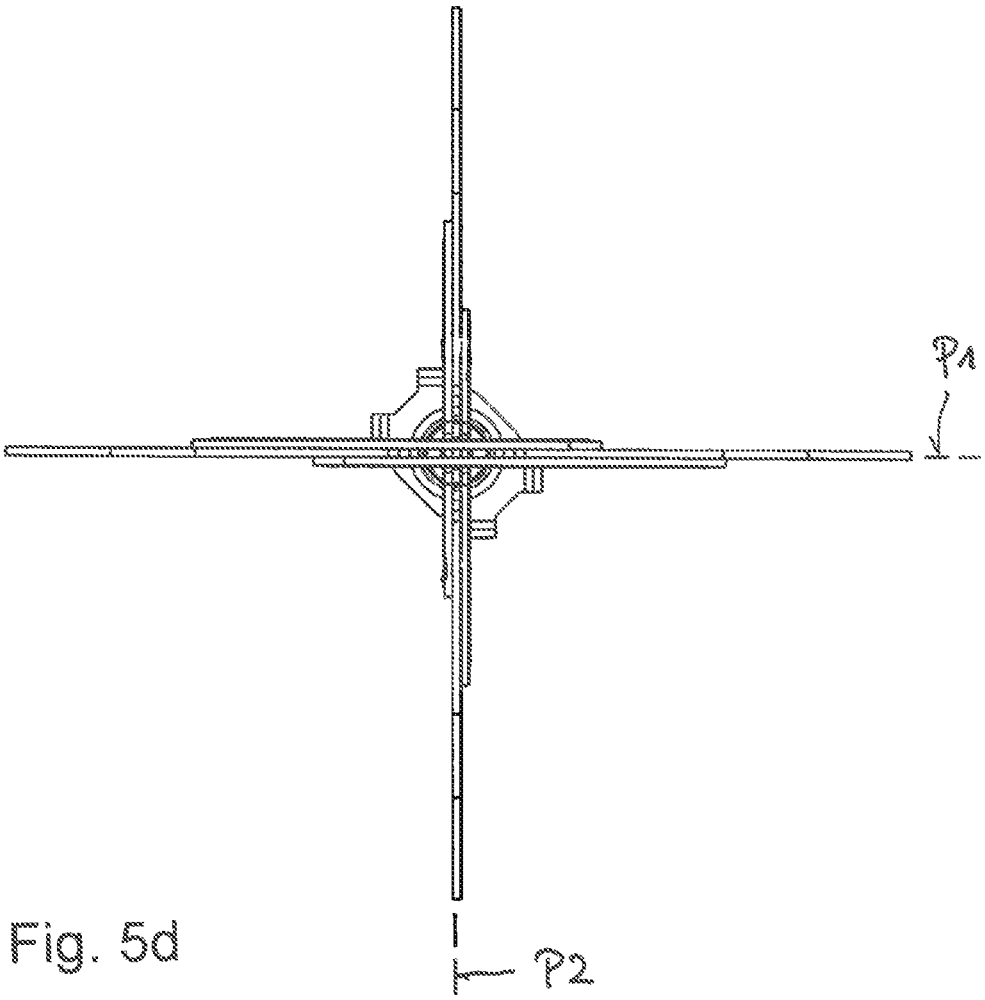
Figure 5E:
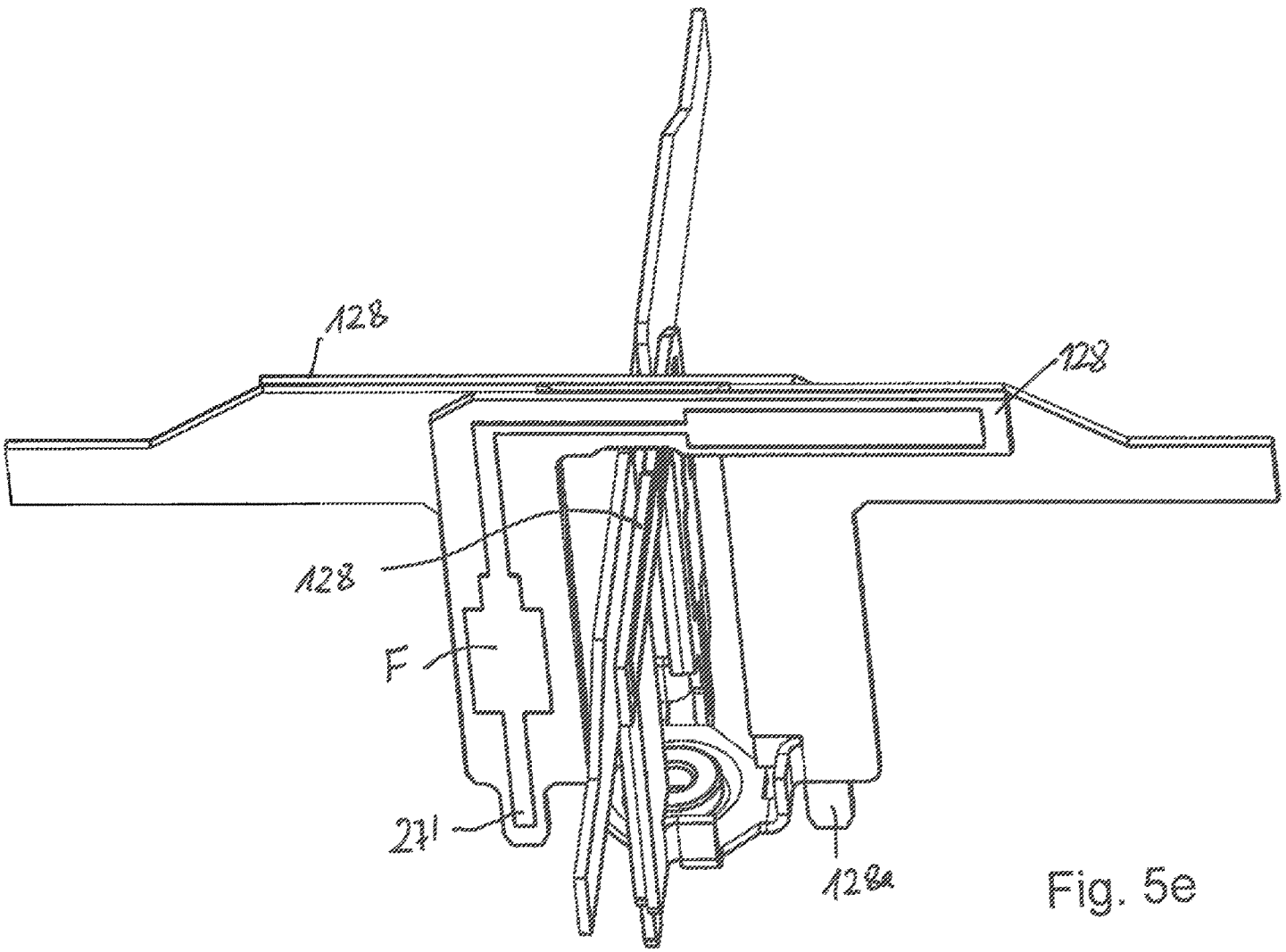
Figure 6A:
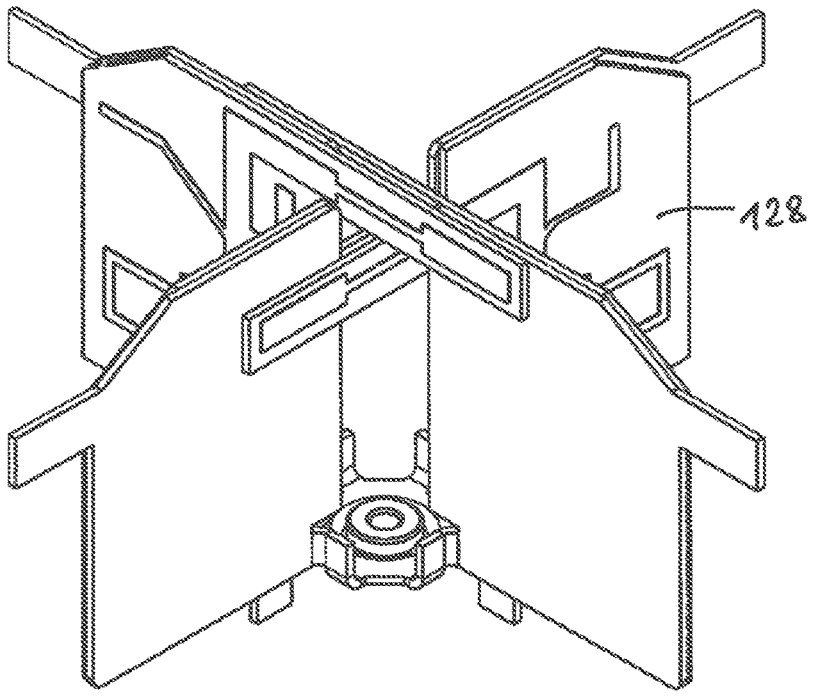
Figure 6B:
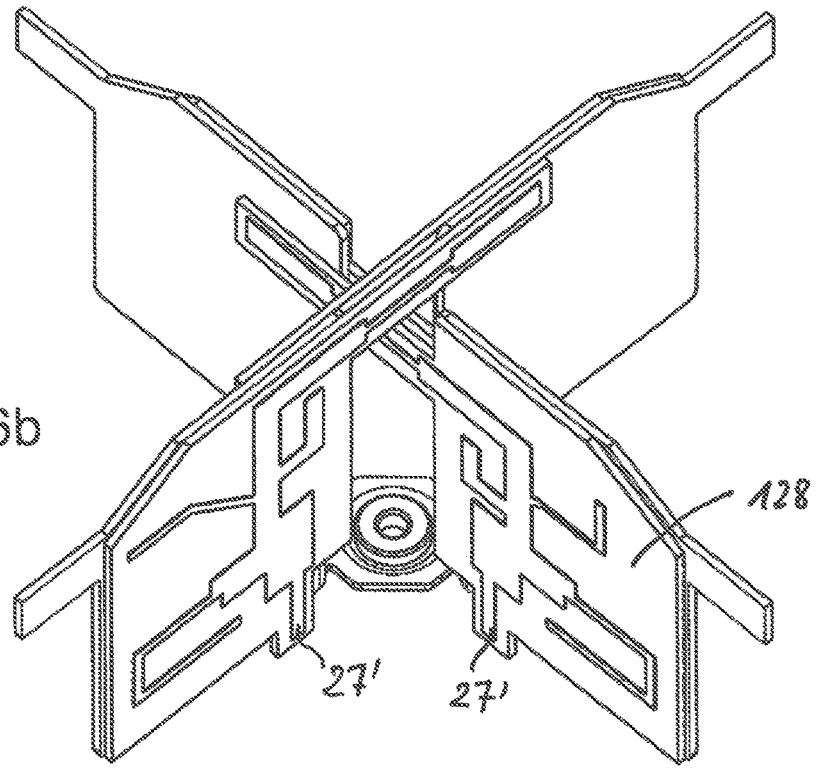
Figure 6C:
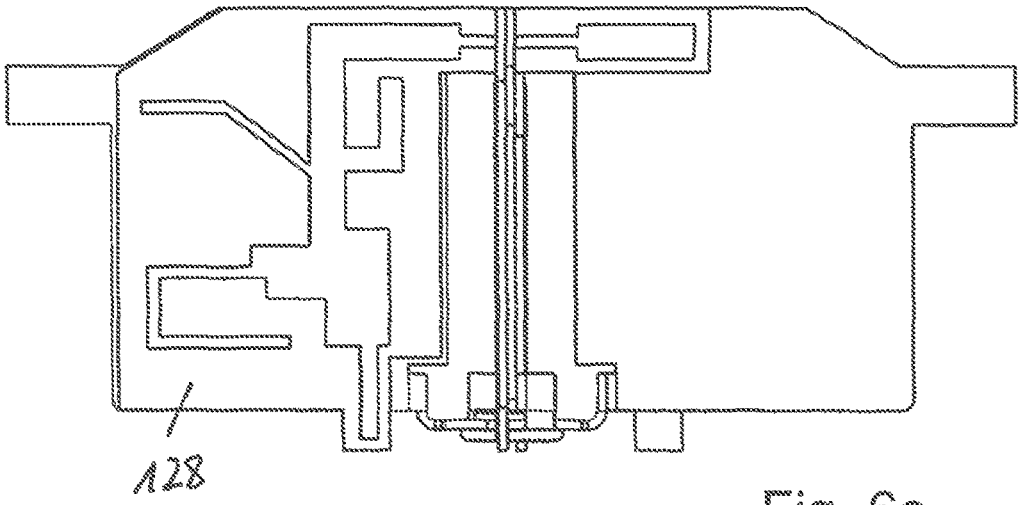
Figure 6D:
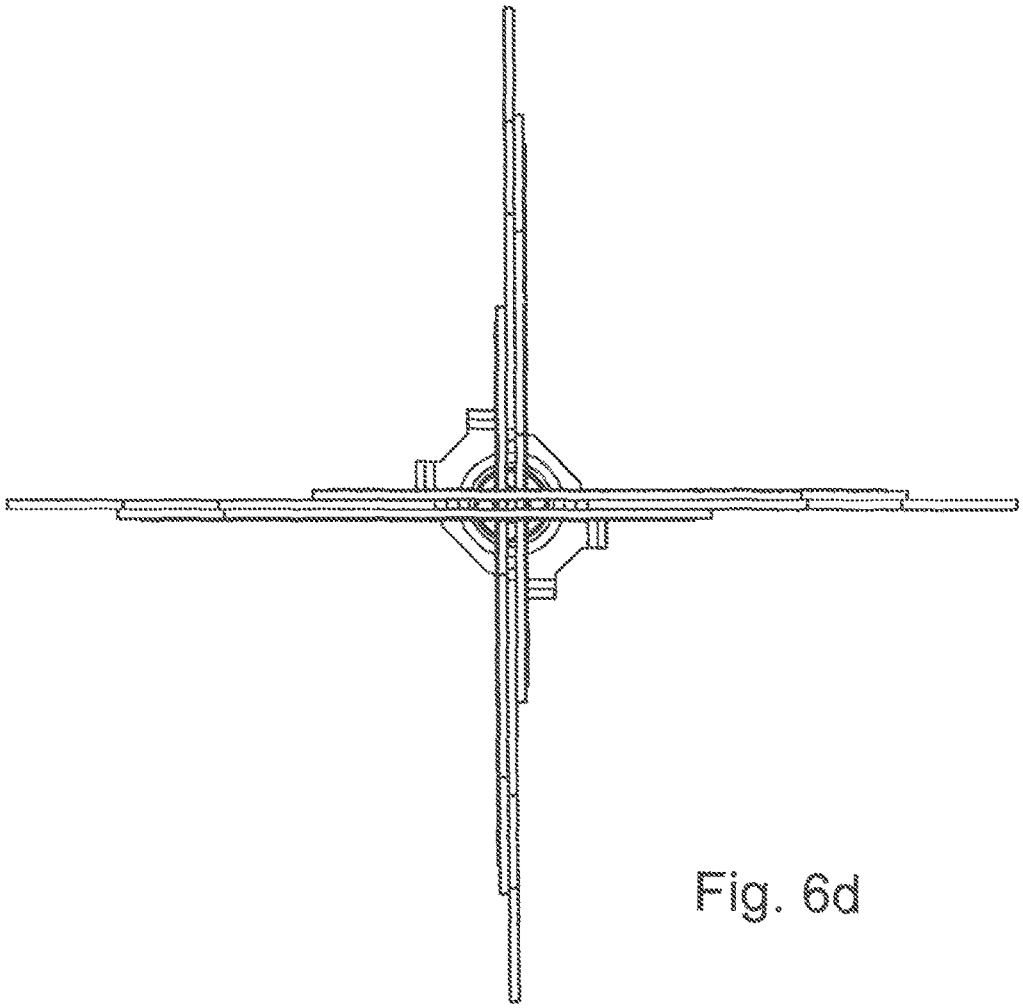

The corresponding coupling for the second feed system for the first polarisation plane and second polarisation plane respectively, viewed perpendicular to the drawing plane in plan view as shown in FIG. 5*d* (i.e. parallel to the centrally located centre axis Z) is made in an identical manner, rotated through 180° (where the centre axis Z runs perpendicular to the drawing plane in FIG. 5*d*). In other words, the two second signal lines of the second feed system run on the respective opposite sides, which likewise face outwards, on the other mount segment in each case, from their bottom connection point up to the height of the top dipole half or radiator half. From here they run preferably at right angles onwards to the opposite dipole-radiator segment and the coupling surface provided there.

Instead of capacitive coupling, however, galvanic coupling could also be implemented here between the signal conductor and the associated dipole half and radiator half.

If the opposite side of the mount 11 from the feed line 27 is metallised, typically over the whole surface, and hence electrically conductive for the purpose of producing the required microstrip lines, then this ground plane can extend into the region of the tab 128*a* (also there on the back as far as the end 27' of the feed line 21), in order then likewise to be connected to ground at a suitable point below the reflector plane RE, i.e. on the back of the reflector or in the region of the reflector itself.

In principle, the microstrip lines could also be formed on the side of the substrate 128 facing the associated mount segment 11.1 and 11.2 of the associated dipole half or radiator half, if an insulating intermediate layer is also provided in particular between this microstrip line and the associated ground plane of the mount 11.1, 11.2 or the dipole surface or radiator surface.

Thus in the embodiment described, a dual feed system is provided for each polarisation plane P1 and P2. In this embodiment, the two feed lines for each of the two polarisation planes can terminate at about the same height.

As is evident from the variants, the first two feed systems for the one polarisation plane P1 are designed, for example, at a height H1, and the two further feed systems lying orthogonal thereto for the polarisation plane lying orthogonal thereto are designed to lie slightly lower, with the line segment thereof extending horizontally from one dipole-radiator half to the opposite dipole-radiator half, so that in this case the two top tracks, which typically run parallel to the reflector plane, can cross one another at a vertical separation without making contact.

The dual feed system using unbalanced coaxial cables described with reference to the first embodiment, however, could equally be implemented for a crossed dipole as illustrated using the second embodiment for the microstrip lines.

It is also mentioned merely for the sake of completeness that in particular the design of the dual feed system for at least one and preferably both mutually orthogonal polarisation planes makes it possible to design matching structures, including filter structures, particularly easily and simply by modifying the design and shape of the microstrip signal lines. Relevant matching elements and/or filter structures F are only suggested in the figures.

The third embodiment, which is fundamentally similar and is shown in FIGS. 6*a* to 6*e*, additionally illustrates that the relevant dielectric mounting plates, i.e. the substrate 128 on which run the microstrip lines 221.1*a*, 221.1*b* for the one polarisation plane P1, and 221.2*a* and 221.2*b* for the second polarisation plane P2, can be designed to be even larger and thereby provide even more space for implementing larger filter structures F and/or matching circuits F.

This makes it possible, for example, to design duplex structures even in the region of the radiator in order to route the signal paths for feeding the transmit signal into the dipole halves and/or radiator halves 5*a*, 5*b* and to route the received signals received thereby onto a transmission path separate therefrom into the downstream receive systems on a frequency-selective basis.

It must be mentioned at this point that much like the embodiment described above, a vector dipole embodied according to the invention can be made from one or more sheet-metal parts, for instance in the form of punched parts. Reference is made purely by way of example to the prior publication DE 20 2005 015 708 U1, which basically discloses such a design. The signal line or feed line disclosed in this document can likewise be implemented again effectively in a dual design.

FIGS. 7*a* to 7*c* show in an exploded view another embodiment, in this case of a vector dipole 5, which basically has a crossed radiator structure.

Said vector dipole can basically have a form like that disclosed purely by way of example and in terms of principle in WO 2008/022703 A1 or WO 2005/060049 A1 or one of the prior publications mentioned and described at the outset.

Said documents disclose that vector dipoles likewise radiate and receive in two mutually orthogonal polarisation planes P1 and P2, each mutually orthogonal polarisation plane running along respective diagonals through a vector dipole. The two radiator halves provided for each polarisation plane are each approximately square-shaped in plan view, or in terms of basic structure approximate a square.

The mount 11 in this case consists of four mount quadrants 11.1*a*, 11.1*b*, 11.2*a*, 11.2*b*, which in plan view are arranged about the central centre axis Z, each shifted through 90°. The mount quadrants of each pair of adjacent mount quadrants are separated by a slot 13 extending from the base upwards and hence practically over the full height of the radiator. In other words, the mount quadrants are only connected to one another via their lower base 17, which only extends at a low partial height. It is also possible that each of the separate mount quadrants, separately from one another are coupled directly galvanically or capacitively to the electrically conducting reflector and fastened mechanically there.

U-shaped wall segments 43, which extend from the centre Z outwards, are formed, each running diagonally i.e. congruent with the two mutually orthogonal polarisation planes P1 and P2, the U-shaped connecting link of which wall segments points outwards so that the four U-shaped, pocket-shaped housing regions 45 formed in this way, shifted through 90° in plan view, meet in the centre to form a common central space 46 or are connected thereby. The signal lines or feed lines 27 described in detail below are also accommodated in the housing regions 45 described.

The diagrams also show that each of the pockets, which are U-shaped in plan view (and which are closed to the outside and meet in the central region to form a common space 46), are also separated from one another by a central dividing wall 47 in each case. In the embodiment shown, this dividing wall is connected at the outer end to the base-shaped link of the U-shaped housing region 45. The opposite boundary edges of this dividing wall 47 facing inwards towards the centre terminate at a separation from one another, so that again said common central inner space 46 is formed.

Said space is dimensioned such that in the individual chambers further partitioned by the dividing walls 47 it is possible to insert the pair of feed systems (shown in the drawings) for each of the two polarisation planes by it being possible to insert for each polarisation plane a dielectric 128 having feed line located thereon.

For this purpose, the pair of feed systems for each of the two polarisation planes P1 and P2, as explained with reference to the two earlier embodiments, preferably have a planar design, with the signal lines being formed as microstrip lines that run on suitable dielectric mounts or substrates 128.

Thus, for instance, a mounting plate or substrate plate 128.1 can be used for the one polarisation plane P1 in one of the partitioned U-shaped pockets, whereas the second mounting plate or substrate plate 128.2 belonging to the same polarisation plane can be inserted, rotated through 180°, into the chamber that lies on the opposite side with respect to the centre Z and is formed on the other side of the dividing wall 47.

The same applies to the two further mounting plates or substrate plates 128 on which are formed the signal lines for the second polarisation plane. In other words, the plates of each pair of mounting plates or substrate plates 128 oriented in parallel with each other and having the two supports extending in opposite directions (i.e. in the sense of a 180° rotation), rotated about the centre axis Z, interact with each other to provide two unbalanced feed systems both for the one polarisation plane P1 and for the second polarisation plane P2.

In addition, the respective horizontal line segments, which terminate in the respective coupling segments, are arranged for the one polarisation plane at a slightly different height from the two horizontal coupling segments and line segments relating to the two further feed systems for the other polarisation plane, resulting basically in a structure like that explained with reference to the two previous embodiments.

It is also shown by way of example for the variant of FIGS. 7*a* to 7*c* that a connecting post 525, which is used for the galvanic ground connection, preferably for each of the two mount halves provided for each polarisation plane P1, P2, on the underside of the base protrudes preferably perpendicular thereto from the electrically conducting mount 11 on the underside thereof. A coaxial, preferably galvanic connection to a ground line (not shown in greater detail) or a ground connection can be made via this connecting post preferably on the underside of the reflector. For this purpose, the connecting post 525 used for the ground connection would be inserted through the reflector through suitable holes. The figures also show that signal connection couplers 701, which in a suitable design can be plugged directly onto the open-ended signal lines extending downwards in an opposite direction from the radiation, can be used for each of the four signal lines.

The variant shown in FIG. 8 is used to illustrate also the fundamental principle of a dual system. In this case, two dipole-type vector radiators 5*c*, which radiate in two polarisation planes P1 and P2, by way of example are arranged on a common mounting plate 63, spaced apart from each other.

The vector dipoles thus comprise respective housing pockets 45, which internally each extend diagonally from the centre Z to the approximately square outer contour of the vector radiator and in which, for example, the associated planar mounts (planar substrate or dielectric) for each polarisation plane P1 and P2 can be inserted into the two chambers separated by the dividing walls 47. On each of these four planar substrates 128, on one side in each case, is formed the described signal line 27.1*a*, 27.1*b*, 27.2*a*, 27.2*b* in the form of a microstrip line 221, so that two feed systems 21.1 and 21.2 are provided for each polarisation plane P1 and P2 respectively.

It must be mentioned for this variant that for each polarisation plane, it is also possible to provide just one substrate, on one side of which the microstrip line 227 for the one feed system is formed, and on the opposite, second side of which is formed the microstrip line for the other feed having the same polarisation with the associated signal line. To implement a capacitive feed, it is simply necessary to ensure that the microstrip lines 227 are galvanically isolated from the adjacent wall segments of the pocket-shaped housing regions 45, e.g. by a suitable insulating intermediate layer etc.

In this case, each of the substrates, i.e. the planar mounts 128, for the two polarisations are designed such that the top coupling segment of each substrate, which extends across the associated slot 13, is provided at a different height level A1 and A2 respectively for the two polarisations in order that the corresponding microstrip line segments for the two polarisation planes can cross.

The invention claimed is:

1. Dipole-type radiator arrangement comprising:

at least one radiator having at least two radiator halves structured to cause the dipole-type radiator arrangement to radiate in at least one polarization plane, the at least two radiator halves being arranged and/or held above a mount in front of an electrically conducting reflector, the mount comprising for each polarization two mount halves, which are separated by a slot running therebetween, which extends between the two mount halves over the full height of the dipole-type radiator or as far as a connecting link formed on the mount base and connecting the two mount halves, the two radiator halves being fed via an unbalanced two-line system comprising a ground line and a signal line, the ground line being coupled galvanically or capacitively in the region of a first radiator half or mount half to this radiator half or mount half, and the signal line extends across the slot to the second radiator half, which is opposite the first radiator half or mount half, and coupled there galvanically or capacitively to said radiator half, a second two-line feed system provided for the at least one polarization plane, the second two-line feed system likewise structured to feed by a further signal line and a further ground line, the second two-line feed system being provided opposite the first two-line feed system with regard to the two radiator halves such that the associated further signal line is galvanically or capacitively coupled to the first radiator half, and the associated further ground line is galvanically or capacitively coupled to the associated second radiator half or mount half, and the first two-line feed system provided for the at least one polarization plane as well as the second two-line feed system provided for the at least one polarization plane are a double feed system with a double feeding.

2. Dipole-type radiator arrangement according to claim 1, wherein for the at least one polarization plane or for both plural polarization planes, the two-line feed system is in the form of an unbalanced two-line feed system.

3. Dipole-type radiator arrangement according to claim 1, wherein the two-line feed system comprises or consists of coaxial cable.

4. Dipole-type radiator arrangement according to claim 1, wherein the two-line feed system comprises or consists of microstrip lines or asymmetric striplines.

5. Dipole-type radiator arrangement according to claim 4, wherein only the signal line runs on the associated mount as a stripline or microstrip line, and a ground coupling is provided at the base region of the mount.

6. Dipole-type radiator arrangement according to claim 4, wherein the striplines or the microstrip lines are formed on a substrate which is separate from the mount and is in the form of a planar substrate.

7. Dipole-type radiator arrangement according to claim 6, wherein the striplines or the microstrip lines are arranged on a side of the substrate that lies further from the mount.

8. Dipole-type radiator arrangement according to claim 6, wherein the striplines or the microstrip lines are arranged on a side of the substrate that faces the mount, with an insulating gap formed between the striplines or microstrip lines and the mount lying adjacent thereto, and/or with the interposition of a further insulating layer or a further insulating substrate.

9. Dipole-type radiator arrangement according to claim 4, wherein the striplines or the microstrip lines extend from a mount base up to the vicinity of a top side of the associated radiator halves, and from there is configured as a line extension leading away across the slot, which becomes a coupling segment which is capacitively or galvanically coupled to the associated radiator half.

10. Dipole-type radiator arrangement according to claim 4, wherein the dipole-type radiator further comprises filter structures as well as structures provided by the striplines or the microstrip lines, and wherein the substrate accommodating the striplines or the microstrip lines is designed to be of such a size that other structures, including the filter structures, formed by the striplines or the microstrip lines are also embodied thereon.

11. Dipole-type radiator arrangement according to claim 1, wherein the at least one radiator consists of or comprises a single dipole radiator, a crossed radiator or a vector radiator.

12. Dipole-type radiator arrangement according to claim 11 wherein the single dipole radiator or the crossed radiator comprises planar mounts, or two mount halves per polarization plane, in parallel with which is arranged a planar substrate provided with a stripline or a microstrip line.

13. Dipole-type radiator arrangement according to claim 11, wherein the vector radiator in the region of the mutually orthogonal polarization planes is equipped with housing regions, which are closed to the outside and open to the center of the radiator and are designed in the form of pockets that are U-shaped in plan view, in which are arranged planar substrates for the signal line formed there.

14. Dipole-type radiator arrangement according to claim 13, wherein the housing regions that are designed in the form of U-shaped pockets are provided with a central dividing wall, so that in each of the thereby partitioned housing regions in the form of U-shaped pockets is provided a substrate having an associated stripline or microstrip line as the signal line.

15. A dipole-type radiator arrangement comprising:

an electrically conducting reflector;

a mount disposed on a side of the electrically conducting reflector, the mount comprising at least first and second mount portions separated by a slot running therebetween, the slot extending between the first and second mount portions at least as far as a connecting link formed on a mount base and connecting the first and second mount portions;

at least one radiator comprising first and second radiator portions structured to radiate in at least one polarization plane, the first and second radiator portions being disposed on the same side of the electrically conducting reflector as the mount and spaced from the mount, and a double feed system with double feeding provided for the at least one polarization plane, the double feed system comprising:

a first unbalanced two-line feed arrangement configured to feed the first and second radiator portions, the first unbalanced two-line feed arrangement comprising a first ground line and a first signal line, the first ground line being coupled galvanically or capacitively to said first radiator portion or first mount portion in a region of a first radiator portion or first mount portion, the first signal line extending across the slot to the second radiator portion, which is opposite the first radiator portion or first mount portion, and coupled galvanically or capacitively to the second radiator portion, and a second two-line feed arrangement provided for the at least one polarization plane, the second two-line feed arrangement comprising a second signal line and a second ground line, the second two-line feed arrangement being provided opposite the first two-line feed system with regard to the first and second radiator portions such that the second signal line is galvanically or capacitively coupled to the first radiator portion, and the second ground line is galvanically or capacitively coupled to the second radiator portion or second mount portion.

* * * * *